United States Patent [19]

Priem et al.

[11] 4,241,159

[45] Dec. 23, 1980

[54] ELECTROPHOTOGRAPHIC LIQUID DEVELOPER COMPRISING ACRYLIC OR METHACRYLIC ACID ESTER OF HYDROGENATED ABIETYL ALCOHOL POLYMER

[75] Inventors: Jan J. Priem, Mortsel; Noël J. De Volder, Edegem; Yvan K. Gilliams, Berchem; Walter F. De Winter, 's-Gravenwezel, all of Belgium

[73] Assignee: AGFA-GEVAERT N.V., Mortsel, Belgium

[21] Appl. No.: 852,977

[22] Filed: Nov. 18, 1977

Related U.S. Application Data

[63] Continuation of Ser. No. 552,804, Feb. 25, 1975, abandoned.

[30] Foreign Application Priority Data

Feb. 26, 1974 [GB] United Kingdom ..... 8689/74

[51] Int. Cl.[2] ..... G03G 9/12

[52] U.S. Cl. ..... 430/114; 430/119; 430/137

[58] Field of Search ..... 252/62.1; 96/1SD; 260/103; 430/114, 119, 137

[56] References Cited

U.S. PATENT DOCUMENTS

| | | | |
|---|---|---|---|
| 2,613,158 | 10/1952 | Walton | 252/62.1 |
| 2,877,133 | 3/1959 | Mayer | 252/62.1 L |
| 3,060,020 | 5/1963 | Greig | 252/62.1 L |
| 3,093,039 | 6/1963 | Rheinfrank | 252/62.1 |
| 3,909,433 | 9/1975 | Gilliams et al. | 252/62.1 |

*Primary Examiner*—John D. Welsh

*Attorney, Agent, or Firm*—William J. Daniel

[57] ABSTRACT

An electrostatic liquid developer for the development of electrostatic charge patterns comprises an electrically insulating carrier liquid having a dielectric constant of less than 3 and a volume resistivity in excess of $10^9$ Ohm.cm. In this electrically insulating carrier liquid are dispersed resin-precoated toner particles formed of a pigment or coloring agent precoated with a polymer of an acrylic or methacrylic acid ester of hydrogenated abietyl alcohol.

11 Claims, No Drawings

ELECTROPHOTOGRAPHIC LIQUID DEVELOPER COMPRISING ACRYLIC OR METHACRYLIC ACID ESTER OF HYDROGENATED ABIETYL ALCOHOL POLYMER

This is a continuation of Ser. No. 552,804, filed Feb. 25, 1975, now abandoned.

The present invention relates to electrophotography, and more particularly to improvements in the development of electrostatic charge patterns and to liquid developers used therefor.

Known electrophotographic processes comprise the steps of electrostatically charging in the dark a photoconductive surface, image-wise exposing the said surface whereby the irradiated areas become discharged in accordance with the intensity of radiation, thus forming a latent electrostatic image, and developing the material to form a visible image by depositing on the image a finely divided electroscopic material known as "toner". The thus developed image may be fixed to the surface of the photoconductor or transferred to another surface and fixed thereon. Instead of forming the latent electrostatic image by the steps described above it is also possible to directly charge the photoconductive layer in image configuration.

In one type of electrophotography, the latent electrostatic image is developed or rendered visible by use of liquid developers comprising coloured toner particles suspended in an insulating carrier liquid, which should have a volume resistivity in excess of $10^9$ Ohm.cm and a dielectric constant below 3. The suspended toner particles, usually finely divided pigments or dyes, are electrostatically charged and develop the latent image under influence of the charge of the latent electrostatic image.

It is known to produce positive-working and negative-working liquid developers. A negative-working developer contains toner particles, which upon contact with a surface bearing latent image areas are repelled by such charges and deposit onto the non-image areas. A positive-working developer behaves in the reverse sense and thus contains particles that are attracted by the electrostatic charges in the image areas.

Electrophotographic coatings containing zinc oxide are charged negatively with the result that the latent image formed by exposure is negative in polarity. Thus, a positive developer can be applied to such zinc oxide layer containing a negative latent image to produce a facsimile reproduction of the orignal radiation pattern whereas a negative developer can be applied to such layer to produce a reversal reproduction of the original radiation pattern.

The polarity of the toner particles with respect to the electrostatic latent image to be developed is determined by the nature of the materials used in the preparation of the liquid developer and by so-called polarity control agents, which confer to the suspended toner particles either a negative or positive charge.

Liquid developers have been produced wherein the toner particles are suspended in an insulating liquid and wherein the said toner particles are precoated with a resin, before dispersing the particles in the insulating liquid.

These resin-precoated toner particles are widely known in the art of liquid electrostatic developers. The resins include natural as well as synthetic resins.

Resin-precoated toner particles are particularly advantageous in electrophotographic multicolor reproduction processes. In these processes images are produced by repeating for each colour separation image the successive operations of charging the photo-conductive element, exposing to a colour image through a filter absorbing the colour to be reproduced, and developing by means of toner particles of the desired colour. In order to allow recharging of the photoconductive element for the formation of the subsequent colour separation image, the image areas of the toner first deposited should be capable of carrying the appropriate charge and comprise therefore an insulating material e.g. a resin coated over the toner deposit. It is possible for this purpose to incorporate the insulating resins in the liquid developing composition. However, large amounts are required, which reduce the intensity of colour deposit. Improved results are obtained when resin-precoated particles are used in the liquid developing composition.

It has now been found that very interesting liquid developing compositions are obtained when the toner particles are precoated with a polymer of an acrylic or methacrylic acid ester of hydrogenated abietyl alcohol.

According to the invention an electrostatic liquid developer for the development of electrostatic charge patterns is provided, comprising an electrically insulating carrier liquid having a dielectric constant of less than 3 and a volume resistivity in excess of $10^9$ Ohm.cm, said electrically insulating carrier liquid having suspended therein resin-precoated toner particles formed of a pigment or colouring agent precoated with a polymer of an acrylic or methacrylic acid ester of hydrogenated abietyl alcohol. As polymers of (meth)acrylic acid esters of hydrogenated abietyl alcohol are meant not only homopolymers, but also copolymers with other copolymerizable monomers as will be more clearly defined hereinafter.

The liquid developer composition of the present invention comprises as a base fluid any of the conventional electrically insulating carrier liquids generally employed in liquid developer compositions. Thus, for example the carrier liquid includes various hydrocarbon solvents; e.g. aromatic hydrocarbons such as benzene, toluene and xylenes, aliphatic hydrocarbons such as hexane, cyclohexane and heptane; fluorocarbons and silicone oils. The carrier liquid is preferably a commercial petroleum distillate e.g. mixtures of aliphatic hydrocarbons preferably having a boiling point comprised between 150° C. and 220° C. such as ISOPAR G, H, K and L (trade names) of the Esso Standard Oil Company, SHELL SOL T (trade name) of the Shell Oil Company, etc. In view of its low dielectric constant and high resistivity the carrier liquid is non-polar.

The pigment or colouring agent used as toner may be any of the pigments and dyestuffs commonly employed in liquid electrostatic toner compositions provided that they carry a resin-coating. Thus, for example, the colouring agent or pigment can be carbon black and various analogous forms thereof e.g. lamp black, channel black, and furnace black.

Suitable coloured pigments include azo dyes, xathene dyes, phthalocyanine dyes, which may be in X-form, e.g. as described in published German Patent Application (DOS) No. 1,944,021, triphenylmethane dyes, diphenylmethane dyes, stilbene dyes, acridine dyes, quinoline dyes, quinone imine dyes, thiazine dyes, azine dyes, etc.

A large variety of dyes are known for use in liquid electrophotographic developers and therefore, the following dyes are given for illustration purposes only: Heliogen Blau LG (a metal-free phthalocyanine blue pigment of BASF), Monastral Blue (a copper phthalocyanine pigment—CI 74160), Heliogen Blau B pulver (BASF), Helioecht Blau HG (Bayer), Brilliant Carmine 6B (CI 15850), Helioecht Rose (Bayer), Quinacridone Magenta (C.I. Pigment Red 122), Thioindigo Magenta (e.g. CI 73310), Fanalrosa B supra pulver (BASF), Lithol Rubine (BASF), Irgalith echt Gelb (Geigy), Benzidin Yellow (C.I. 21090, 21100), Hansa Yellow (e.g. CI 11680), Permanentgelb GR 52 (Hoechst), Monolit Gelb GNS (ICI), Helioecht Gelb GRN (Bayer), etc.

Hydrogenated abietyl alcohol results from the reduction of commercially available hydrogenated abietic acid, which itself is obtained upon hydrogenation of abietic acid, the chief resin acid of wood rosins. These resin acids are hydrogenated to remove the double bonds present in the resin acid, to stabilize the product and to destroy colour bodies found in natural wood rosins. Hereby a mixture of dihydroabietic acid and tetrahydroabietic acid is obtained. STAYBELITE RESIN is the registered trade-mark of Hercules for a hydrogenated abietic acid, the degree of saturation of which exceeds 50% of that theoretically possible. RESIN 861 is another trade-mark of Hercules for a hydrogenated abietic acid.

Upon reduction of hydrogenated abietic acid to hydrogenated abietyl alcohol a mixture of dehydro, dihydro, and tetrahydroabietyl alcohols is obtained. ABITOL is the registered trade-mark of Hercules for a mixture formed of about 15% of non-alcoholic material, the alcohol portion being formed of about 45% of tetrahydroabietyl alcohol, 40% of dihydroabietyl alcohol and 15% of dehydroabietyl alcohol.

By the term "hydrogenated abietyl alcohol" in the present description and claims there is understood that this hydrogenated abietyl alcohol is formed of a mixture of dihydro, dehydro, and tetrahydroabietyl alcohols.

The acrylic or methacrylic acid esters of hydrogenated abietyl alcohol, also named for practical purposes (meth) acrylic acid esters of ABITOL or ABITOL (meth)acrylates may be obtained by a direct esterification reaction using the method described by C. S. Marvel and R. Schwen in J. Am. Chem. Soc., 79, 6003–5 (1957) or by a transesterification reaction. In the latter method hydrogenated abietyl alcohol is dissolved in a suitable solvent in the presence of a hydrogen chloride acceptor and to this solution acryloyl or methacryloyl chloride is slowly added, as will be described more detailedly hereinafter.

The acrylic or methacrylic acid esters of hydrogenated abietyl alcohol may be homopolymerized or copolymerized with other $\alpha,\beta$-ethylenically unsaturated monomers, according to different polymerization methods, such as solution, bulk, suspension or emulsion polymerization techiniques. Suitable comonomers are e.g. styrene, o- and p-chlorostyrene, vinyl toluene, $\alpha$-methyl styrene, vinyl methyl ether, vinyl ethyl ether, vinyl acetate, vinyl chloroacetate, versatic acid vinyl ester (which is a branched chain vinyl carboxylic acid ester having a molecular weight of 198 and corresponding to the formula:

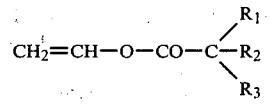

wherein each of $R_1$, $R_2$, and $R_3$ represents an alkyl group having together 7 to 9 carbon atoms, and wherein only one of $R_1$, $R_2$, and $R_3$ is a methyl group, this monomer being sold by Shell Chemical Co. under the trade name VEOVA), vinyl propionate, vinyl pyrrolidone, alkyl esters of acrylic acid or methacrylic acid, itaconic acid and maleic acid wherein the alkyl group(s) comprises 1 to 5 carbon atoms, phenyl acrylates and methacrylates, acrylonitrile, and methacrylonitrile, mono- and dimaleates, vinyl chloride, vinylidene chloride, ethylene, propylene, acryl and methacryl amide and their N-substituted derivatives, glycidyl ester of (meth)acrylic acid, (meth)acrolein, butadiene, indene and coumarone. Interesting copolymers are obtained when small amounts of polyfunctional monomers are added to the polymerization mixture, whereby during polymerization a cross-linking by means of the polyfunctional monomers is obtained. Examples of polyfunctional monomers are e.g. divinyl benzene, glycol di(meth)acrylates and N,N'-alkylene-bis-(meth)acrylamides. Equally interesting products are obtained when the polymerization reaction is carried out in the presence of small amounts of rubber-like polymers or copolymers such as e.g. a copolymer of styrene and butadiene, whereby a graft copolymer is formed.

Usually, after polymerization, the polymers formed are isolated before being worked up with the pigment or dyestuff.

Better results are obtained by a solvent-free polymerization process wherein the monomer or monomers, a pigment or a dyestuff and a polymerization initiator are treated together in a kneading apparatus for a time and at a temperature sufficient to effect homopolymerization or copolymerization. The kneaded mass is thereafter cooled and ground to a fine toner powder. In this way resin-precoated pigment or dyes are directly formed so that there is no need anymore for previously insolating the polymer from the polymerization mixture before its working up with the pigment or dye.

In a very interesting embodiment of the invention the polymerization of acrylic and methacrylic acid esters of hydrogenated abietyl alcohol is carried out in the presence of dyestuffs, which can be copolymerized by a free radical mechanism via built-in unsaturated bonds. In this way directly coloured copolymerization products are obtained.

In addition to the polymers of acrylic or methacrylic acid esters of hydrogenated abietyl alcohol, a liquid electrophotographic developer according to the present invention may contain other polymeric binding agents to adjust viscosity of the liquid dispersion or as charge fixing agents, such as polyacrylates and methacrylates, copolymers of styrene with acrylates or methacrylates, alkyd resins, and the like. Very interesting is the comercially available copolymer of isobutyl methacrylate and stearyl methacrylate comprising about 0.2% of methacrylic acid marketed by Polyvinylchemie, The Netherlands, under the trade-name NEOCRYL B 702. Another suitable additional polymer is ANTARON V 216, an olefin-alkylated polyvinylpyrrolidone, marketed by GAF.

Positively polarizing agents may also be present e.g. metal soaps of fatty acids such as aluminium stearate, zinc stearate, lead stearate, copper stearate, cadmium stearate, calcium stearate, zinc palmitate, aluminium palmitate, lithium octoate, aluminium dresinate (aluminium salt of abietic acid), vanadium dresinate, tin dresinate, copper linoleate, manganese linoleate, etc. and the bivalent or trivalent metal salts of an oxyacid derived from phosphorus containing at least one organic residue according to British Pat. No. 1,151,141.

The amount of other possible positively polarizing agents e.g. the metal soaps and bivalent or trivalent metal salts of phosphorus oxyacids as referred to hereinbefore, will vary according to the nature of the charge already on the resin-precoated toner particles and depends on the desired effect e.g. obtaining a developer yielding images of steep or soft gradation. Moreover, it is possible to control by means of the amount of the above positively polarizing agents, the polarity of the toner particles so as to obtain optimum relation between image density and contrast and stability of the liquid composition against settling of the toner particles. An individual determination of the required quantity may be made for each new combination by some simple experiments. The amounts should, of course, be such that they do not lower the volume resistivity of the resulting composition below $10^9$ Ohm.cm or raise the dielectric constant above 3.

The manner in which the liquid electrophotographic developing composition is produced is by no way critical. It is conventional to prepare by means of suitable mixers, e.g. 3-roll-mills, ball mills, colloid mills, homogenizers, high speed stirrers, etc. a concentrate in the insulating carrier liquid of the materials selected for the composition, and subsequently to add further insulating carrier liquid to form the liquid toner composition ready for use in the electrostatic reproduction process.

The resin-precoated pigment or dye is employed in the composition ready for use in the amount necessary to be capable of being deposited, when attracted to the electrostatic image, so that the desired image density is reached. In general, the pigment or colouring agent is used in an amount comprised between about 0.01 g and 10 g per liter, preferably between about 0.01 g and about 2 g per liter.

The ratio of resin to pigment or dye may vary within very wide limits. The resin preferably outweighs the pigment or dye but should permit to obtain sufficient density. A preferred weight ratio is comprised between about 1:1 and about 10:1.

Resin-precoated toner particles are obtained according to the invention. They present several very interesting properties, especially when polymerization occurs by kneading the monomer or monomers in the presence of the pigments or dyes. In this way not only a more uniform pigment distribution in the polymer is obtained, but the polymerization also results in resins that are more insoluble in the insulating carrier liquids, such as in ISOPAR, as compared with the solubility therein of polymers obtained according to normal solution, suspension or emulsion polymerization techniques.

The coatings obtained by direct bulk copolymerization in the kneader of the (meth)acrylic acid esters of Abitol in the presence of a pigment and also of a small amount of a difunctional monomer (e.g. divinylbenzene or glycol di(meth) acrylates, are even less soluble both in cold and hot aliphatic hydrocarbons as compared with the above polymer coatings.

The best results as to insolubility in aliphatic hydrocarbons are obtained when on the pigment particles coatings are formed from polymers obtained by bulk copolymerization in the kneader of Abitol (meth)acrylates in the presence of co-monomers such as (meth)acrylates and styrene, the homopolymers of which are themselves relatively insoluble in aliphatic hydrocarbons, particularly when also small amounts of difunctional monomers such as ethylene glycol dimethacrylate are present for cross-linking purposes. Good results as to insolubility are also obtained when polymerization in the kneader occurs in the presence of small amounts of rubber-like polymers such as copolymers of styrene and butadiene, whereby possibly graft copolymers are formed.

Even in the case of these lowest solubilities the polymer coatings are still partially solvated due to the presence in the polymer of the abietyl or hydroabietyl moieties. This amphiphatic behaviour of the polymer coating procures very interesting properties to the electrographic toner. The dispersion of the toner particles has an increased stability because there exists no absorption-desorption equilibrium as in conventional toners, and since the polymer coating acts as a dispersing agent for the pigment particles, the stability of the toner dispersion is increased even more. Since the polymer coating is preferentially insoluble in the aliphatic hydrocarbons, it is deposited together with the pigment during electrophoretic development. This gives less enrichment of polymer in the toner during prolonged use in a copier, as is the case with coventional electrophotographic toners. Furthermore the polymer coating adds to the effectiviness of the charge determining species. This fact allows a drastical diminishing of the content of classical soluble charge-determining substances in the toner, and increases the stability of the charges on the toner particles over long periods of time.

It can be concluded that an electrophotographic toner consisting of the precoated pigments obtained according to the process of the invention, gives a developer, the essential properties of which, such as stability, particle diameter, and charge, do not change when the developer is stored for long periods of time.

The scope of the invention has been restricted to the use as precoating resins of homopolymers and copolymers of acrylic or methacrylic acid esters of hydrogenated abietyl alcohol. It is interesting to know that also homopolymers or copolymers of vinyl esters of hydrogenated abietic acid may be used for the same purpose.

The vinyl ester monomers of hydrogenated abietic acid may be produced by an interchange reaction between vinyl acetate and hydrogenated abietic acid, in the presence of mercury(II) salts of strong acids as catalysts. Hereby the "vinyl interchange" reaction is followed which has been described by R. L. Adelman in J. Organic Chemistry, 14, 1057 (1949), and by J. B. Lewis and G. W. Hedrick in J. Polymer Science, Part A-1, 4, 2026 (1966).

The preparation of monomeric acrylic or methacrylic acid esters of hydrogenated abietyl alcohol, their homopolymerization or copolymerization, and also the preparation of vinyl esters of hydrogenated abietic acid and their polymerization products as well as the use of the polymerization products in precoating toner particles and forming electrostatic liquid developers, are exemplified in the following examples.

EXAMPLE 1

Methacrylic acid ester of hydrogenated abietyl alcohol (ABITOL)

2 moles of diethylaniline and 0.5 g of m-dinitrobenzene were added to a solution of 2 moles of ABITOL (trade name) dissolved in 2 liters of benzene free from thiophene and water. Thereafter 2.5 moles of methacryloyl chloride were added in 1 h while stirring at room temperature. After having been stirred for 2 hours at room temperature, the solution was stirred for 1 hour more at reflux temperature, whereafter the solution was cooled overnight. During cooling the diethylaniline chlorohydrate formed crystallized out. This precipitate was filtered off and the filtrate was consecutively washed with 2 N hydrochloric acid, a saturated sodium hydrogen carbonate solution in water and thereafter with water until neutral. The solution in benzene was dried with magnesium sulphate, whereafter the benzene was evaporated. An amount of 620 g of a thick viscous oil obtained was fractionated. Only the fraction distilling between 150° and 210° C. at a pressure of 0.7–1 mm Hg was retained. The structure of the ester was confirmed by infrared analysis.

EXAMPLE 2

Methacrylic acid ester of hydrogenated abietyl alcohol (ABITOL)

According to the method described by C. S. Marvel and R. Schwen in J. Am. Chem. Soc. 79, 6003–5 (1957), 100 ml of toluene, 0.46 mole of methacrylic acid, 0.4 mole of ABITOL (trade name), 15 g of hydroquinone and 0.5 g of p-toluene sulphonic acid were introduced in a reaction flask provided with a Dean and Stark separator. The mixture was heated at reflux temperature until about 7 ml of water had been eliminated. The cooled benzene solution was then washed several times with water and dried upon magnesium sulphate. After the addition of a new quantity of hydroquinone as polymerization inhibitor, the residual oil was fractionated. The fraction distilling between 150° and 180° C. at a pressure of 0.05 to 0.1 mm of Hg was retained. The structure of the ester was confirmed by infrared analysis.

EXAMPLE 3

Vinyl ester of hydrogenated abietic acid (RESIN 861)

According to the method described by J. B. Lewis and G. W. Hedrick in J. Polymer Science, Part A-1, 4, 2026–27 (1966), 1.2 g of copper(II) acetate, 3.5 liters of vinyl acetate, and 800 g of RESIN 861 (trade name) were stirred until a solution was formed. Mercury(II) acetate and 3.2 ml of strong sulphuric acid were added successively to this solution. After having been stirred the solution was kept for 72 hours at 20°–25° C., whereafter the reaction mixture was filtered and the excess of non-reacted vinyl acetate was evaporated. 800 ml of a yellow-brown viscous oil was obtained and fractionated. Only the fraction distilling at 160°–170° C. at a pressure of 0.2 mm of Hg was retained.

Nuclear magnetic resonance analysis confirmed the structure of the vinyl ester of hydrogenated abietic acid, but at the same time indicated the presence of a small quantity of impurities, already present in the starting RESIN 861.

EXAMPLE 4

Solution homopolymerization of methacrylic acid ester of ABITOL 400 g methacrylic acid ester of ABITOL (Example 1) were dissolved in 400 ml of benzene free from thiophene and water, together with 10 g of azodiisobutyronitrile as polymerization initiator. The solution was stirred for 24 hours at 65° C. whilst a stream of nitrogen gas was conducted through the solution. Thereafter the already viscous solution was stirred for 24 hours at 83° C.

After dilution with 500 ml of benzene, the polymer was isolated by pouring the reaction mixture in an excess of acetone. Upon drying 335 g of polymer having a glass transition temperature of 180° C. were obtained. Yield: 81%.

EXAMPLE 5

Emulsion homopolymerization of methacrylic acid ester of ABITOL 200 ml of a 1% solution of the sodium salt of oleylmethyltauride and 40 g of monomer (Example 1) were rinsed with nitrogen at room temperature for 1 hour with stirring and then heated at 75° C. 1 hour after the addition of 0.5% of potassium persulphate as an aqueous solution, the polymerization had not yet started. The temperature was then increased to 95° C., so that polymerization started. It was allowed to continue for 17 hours, whereafter the mixture was cooled. Part of the polymer formed had coagulated on the stirrer. After filtration 130 ml of a beige latex was obtained having a concentration of 6% by weight.

EXAMPLE 6

Solution homopolymerization of vinyl ester of RESIN 861

5 g of monomer (Example 3) was dissolved in 20 ml of benzene free from thiophene and water, wherein also as initiator, 250 mg of azodiisobutyronitrile was dissolved. The solution was introduced in a pressure tube, rinsed with nitrogen gas, and the tube closed and heated for 48 hours at 65° C. The polymer formed was isolated by pouring in an excess of acetone. 0.3 g of white powder were obtained.

EXAMPLE 7

Block homopolymerization of vinyl ester of RESIN 861

5 g of monomer (Example 3) and 250 mg of azodiisobutyronitrile were introduced in a pressure tube, which was rinsed with nitrogen and then sealed. Heating followed for 24 hours at 65° C. The thick viscous mass was diluted with 10 ml of methylene chloride, and then poured in an excess of acetone. 1.5 g of polymer were obtained having an intrinsic viscosity of 0.042 dl/g, measured in methylene chloride at 25° C. The melting point of the polymer was 145° C.

EXAMPLE 8

Solution copolymerization of methacrylic acid ester of ABITOL

The methacrylic acid ester of ABITOL (example 1) and a comonomer were dissolved in 100 ml of benzene free from thiophene and water in a reaction flask provided with a stirrer, a reflux condenser, and an inlet for nitrogen, which was heated on a water-bath at a temperature comprised between 65° and 85° C. 0.5% of azodiisobutyronitrile were added as polymerization initiator. Polymerization proceeded for 24 hours. After dilution of the polymer solution, the polymer was precipitated with a precipitating agent. The results are given in the following table.

| Run | Polymerization composition: ABITOL methacrylate | Comonomer | Tg °C. | Melting range | Intrinsic viscosity dl/g | Analysis of copolymer: % by weight of Comonomer |
|---|---|---|---|---|---|---|
| | | ethyl acrylate | | | | |
| 1 | 90 | 10 | 100 | 146–186 | 0.064 | 11.8 |
| 2 | 80 | 20 | 93 | 133–173 | 0.276 | 20.5 |
| | | isobutyl methacrylate | | | | |
| 3 | 90 | 10 | 68 | 143–189 | 0.08 | 13 |
| 4 | 80 | 20 | 75 | 162–202 | 0.08 | 25 |
| 5 | 70 | 30 | 72 | 116–172 | 0.05 | 38.5 |
| 6 | 60 | 40 | 95 | 140–190 | 0.05 | 46 |

Tg = glass transition temperature (determined by thermal analysis with constant heating stream according to the method described by E. Steffens in J. Appl. Pol. Sci., 12, 2317–2324 (1968)).
The intrinsic viscosity was measured in butanone at 25° C.
Although the polymers were insoluble in cold ISOPAR G, they remained partially soluble in hot ISOPAR G.

EXAMPLE 9

Solvent-free homopolymerization in a kneading apparatus of the methacrylic acid ester of ABITOL in the presence of colour pigments

(a) Yellow pigment 200 g of ABITOL methacrylate (example 1) and 100 g of Helioecht Gelb GRN (Bayer) were introduced in a kneading apparatus of MEILI, Switzerland, type Liliput 030 L.N. The kneading apparatus was heated with circulating oil having a temperature of 110° C., so that the temperature of the kneaded mass reached 80°–90° C. Over the kneaded mass nitrogen gas was blown. As soon as a homogeneous mass was obtained having the above indicated temperature, 1.2 g of azodiisobutyronitrile were added. Kneading was continued for 2 h, while nitrogen was blown continuously over the reaction mass. After about 30 min the mass became more and more viscous.

After kneading for 2 h a tough, viscous mass was formed. Another 1.2 g of azodiisobutyronitrile was added and kneading was continued for 4 h under nitrogen and thereafter for 2 h without nitrogen. The kneaded mass was cooled overnight, broken, and ground in a grinding apparatus I.K.A. model A10 (of Janke & Kunkel, W. Germany) so as to obtain a fine powder of resin-precoated yellow pigment. The sticking temperature of the powder on a Kofler hot bench was about 220° C.

(b) Magenta pigment

The process described under (a) above was repeated with 200 g of ABITOL methacrylate (example 1), 100 g of FANALROSA B supra pulver (BASF) and 2 g of azodiisobutyronitrile.

After cooling and milling a resin-precoated magenta toner was obtained sticking on a Kofler hot bench at about 210° C.

(c) Cyan pigment

The process described under (a) was repeated with 200 g of ABITOL methacrylate and 100 g of HELIOECHTBLAU H.G. (Bayer) and 2 g of azodiisobutyronitrile.

After cooling and grinding a resin-procoated cyan toner was obtained, sticking on a Kofler hot bench at about 210°–212° C.

During solvent-free polymerization and copolymerization of ABITOL methacrylate in the kneading apparatus, the different colour pigments could also be replaced by carbon black so that a black electrophotographic liquid developer was obtained.

EXAMPLE 10

Working up of resin-precoated pigments and use as electrophotographic liquid developer

(a) Yellow pigment

In a ball-mill 2 g of the resin-precoated yellow pigment are prepared in Example 9 (a) were ground for 10–15 h together with:

- 10 g of a 30% by weight solution of NEOCRYL B 702 (trade name for a methacrylate copolymer marketed by Polyvinylchemie, The Netherlands. ISOPAR G (trade name for an aliphatic hydrocarbon having a boiling range of 160°–175° C. and a KB value of 27, marketed by the Esso Standard Oil Company) was used as a solvent.
- 6 ml of a 2% weight/volume % solution in ISOPAR G of ANTARON V 216 (trade name for an olefin-alkylated polyvinylpyrrolidone, marketed by GAF),
- 10 ml of a 0.2% (w/vol) solution in ISOPAR G of zinc mono-2-butyloctyl phosphate,
- 25 ml of ISOPAR G.

When 10 ml of the above concentrated liquid developing composition were diluted with 1 liter of ISOPAR G, a stable positive-working electrophotographic liquid yellow developer was formed for the development of a latent electrostatic image formed on a conventional electrophotographic recording element comprising paper coated with photoconductive zinc oxide in a resinous binder, by negative charging and image-wise exposure to light. The developer was suitable for continuous-tone reproduction.

In the above concentrated liquid developing composition the ANTARON V 216 could be omitted, but in this case the 25 ml of ISOPAR G were replaced by 35 ml of ISOPAR G.

(b) Magenta pigment

In a ball-mill 2 g of the resin-precoated magenta-pigment as prepared in Example 9(b) were ground for about 10 hours with:

10 g of a 30% by weight solution of NEOCRYL B 702 in ISOPAR G.

4 ml of a 0.2% (w/vol) solution of zinc mono-2-butyloctyl phosphate in ISOPAR G.

25 ml of ISOPAR G.

The concentrated liquid developing composition was diluted as indicated for the yellow pigment, and formed a stable positive-working electrophotographic liquid magenta developer, which was suitable for continuous-tone reproduction.

(c) Cyan pigment

In a ball-mill 2 g of the resin-precoated cyan pigment as prepared in Example 9(c) were ground for about 10 hours with:

10 g of a 30% by weight solution of NEOCRYL B 702 in ISOPAR G 3 ml of a 2% (w/vol) solution of ANTARON V 216 in ISOPAR G 2 ml of a 0.2% (w/vol) solution of zinc mono-2-butyloctyl phosphate in ISOPAR G 25 ml of ISOPAR G.

The concentrated liquid composition was diluted as indicated for the yellow pigment, and now formed a stable positive-working electrophotographic liquid cyan developer, which was suitable for continuous tone reproduction.

The ANTARON V 216 could also be omitted from the developer composition, but in that case the amount of ISOPAR G in the concentrated liquid composition was increased to 35 ml.

EXAMPLE 11

The processes described in Example 9 were repeated with mixtures of 100 g of magenta pigment FANAL-ROSA B SUPRA PULVER (BASF), different amounts of ABITOL methacrylate (Example 1) and different amounts of a comonomer or of comonomers. The kneading apparatus was heated with circulating silicon oil at 110° C., whereafter 1% by weight of azodiisobutyronitrile was added. After about 2 h of kneading another 1% of azodiisobutyronitrile was added and polymerization was continued for another 2 h, whereafter the mass was cooled and ground in a grinding apparatus.

The results are given in the following table.

| Experiment | ABITOL methacrylate | Comonomer(s) | polyfunctional comonomer | magenta pigment | solubility in ISOPAR G* |
|---|---|---|---|---|---|
| 1 | 180 g | — | divinylbenzene 20 g | 100 g | 28% |
| 2 | 180 g | — | ethylene glycol dimethacrylate 20 g | 100 g | 21% |
| 3 | 100 g | isobutyl methacrylate 90 g | ethylene glycol dimethacrylate 10 g | 100 g | 4% |
| 4 | 100 g | styrene 90 g | ethylene glycol dimethacrylate 10 g | 100 g | 2.5% |
| 5 | 100 g | isobutyl methacrylate 45 g + styrene 45 g | ethylene glycol dimethacrylate 10 g | 100 g | 7.1% |

*The solubility in ISOPAR G is the % by weight of dissolved copolymer with respect to the total weight of monomers present in a 4 w/vol % solution.

EXAMPLE 12

Preparation of liquid electrophotographic toners (a) The following products were introduced in a ball-mill:

10 g of NEOCRYL B 702 as a 30% by weight solution in ISOPAR G, 2 g of a resin-precoated pigment as prepared in Example 11, (experiment 1).

According to the table in Example 11, the solubility of this resin-precoated pigment in ISOPAR G was 28% by weight.

Exactly 1 ml of a 0.2% solution of zinc mono-(2-butyloctyl) phosphate in ISOPAR G was also added to this mixture.

ISOPAR G was now added to make a total volume of 50 ml, and the whole was milled for 15 h.

To form the premix-bath 10 ml of the thus milled solution were added to 1 liter of ISOPAR G. After 1 month the charge of the toner was reduced to half the original value.

(b) In Example 12(a) the 2 g of resin-precoated pigment were replaced by 2 g of the resin-precoated pigment of Example 11, Experiment 3, the solubility of which in ISOPAR G was only 4%. The charge of the premix - bath, formed in the same way as in (a), changed only slightly in 1 month.

EXAMPLE 13

In a kneading apparatus of MEILI, Switzerland, type Liliput 030 L.N, which was heated with circulating silicon oil having a temperature of 110° C., 150 g of a rubber-like copolymer of styrene and butadiene were introduced.

After heating and kneading until a molten mass was obtained 125 g of Abitol methacrylate monomer (of Example 1) and 9 g of benzoyl peroxide were added. The continuously kneaded mass was kept at a temperature between 100° and 105° C. for 24 h, whereupon 100 g of magenta pigment Fanalrosa B supra pulver (B.A.S.F.) were added.

To obtain a fine distribution of the pigment, kneading was continued for at least 30 min. After cooling of the mass and grinding in a suitable grinding apparatus (or in the cooled kneading apparatus itself) the grafted and precoated pigment was worked up to a liquid toner composition. For this purpose the following ingredients were introduced in a ball-mill:

10 g NEOCRYL B 702 as a 30% by weight solution in ISOPAR G 2 g of the precoated magenta pigment formed above.

To this mixture exactly 1 ml of a 0.2% solution of zinc mono(2-butyloctyl)-phosphate in ISOPAR G was also added and further mixed with ISOPAR G until a total volume of 50 ml was reached.

The whole composition was milled in the ball mill for 15 hours and thereafter a premix-bath was formed by diluting the above toner concentrate with 1 liter of ISOPAR G. The toner particles had an average diameter of 0.39 μm. The charge of the premix-bath changed only slightly after a storage for 2 months.

The use of this liquid magenta toner to develop a zinc oxide plate, which had been charged uniformly and then image-wise exposed to light, resulted in the formation of images of excellent image quality, sufficient and equal density, and good adhesion of the image parts of the support.

What we claim is:

1. An electrostatic liquid developer for the development of electrostatic charge patterns of the type comprising an electrically insulating carrier liquid having a dielectric constant of less than 3 and a volume resistivity in excess of $10^9$ Ohm.cm, and suspended within said electrically insulating carrier liquid resin-precoated toner particles, said particles comprising coloring matter dispersed within and precoated by a said polymer, wherein said precoating polymer is a polymer of a monomeric acrylic or methacrylic acid ester of hydrogenated abietyl alcohol and is obtained by in situ polymerization accompanied by mechanical mixing in the presence of said coloring matter and a polymerization initiator, said precoating polymer being generally insoluble in said carrier liquid.

2. An electrostatic liquid developer according to claim 1, wherein said precoating polymer is a copolymer of an acrylic or methacrylic acid ester of hydrogenated abietyl alcohol and at least one copolymerizable monomer.

3. An electrostatic liquid developer according to claim 2, wherein said copolymerizable monomer is isobutyl methacrylate, styrene, orethylene glycol dimethacrylate.

4. An electrostatic liquid developer according to claim 1, wherein said polymer is a graft copolymer of an acrylic or methacrylic acid ester of hydrogenated abietyl alcohol and a rubber-like polymer.

5. An electrostatic liquid developer according to claim 4, wherein said rubber-like polymer is a copolymer of butadiene and styrene.

6. An electrostatic liquid developer according to claim 1, which also comprises a bivalent or trivalent metal salt of a phosphorus oxyacid.

7. An electrostatic liquid developer according to claim 6, wherein said metal salt of phosphorus oxyacid is zind mono(2-butyloctyl)-phosphate.

8. An electrostatic liquid developer according to claim 2, wherein said copolymerizable monomer is a polyfunctional monomer selected from divinylbenzene, glycol di(meth)acrylates and N,N'-alkylene-bis-(meth-)acrylamides.

9. An electrostatic liquid developer according to claim 1, wherein said colouring matter is present in the electrically insulating carrier liquid in an amount comprised between about 0.01 g and 10 g per liter.

10. An electrostatic liquid developer according to claim 1, wherein the ratio of said polymer to said colouring matter is comprised between 1:1 and about 10:1 by weight.

11. A method of liquid development of an electrostatic charge pattern which comprises the steps of bringing the charge pattern in contact with a liquid developing composition comprising an electrically insulating carrier liquid having a dielectric constant of less than 3 and a volume resistivity in excess of $10^9$ Ohm. cm and resin-precoated toner particles suspended in said carrier liquid, said toner particles comprising colouring mattern dispersed in and precoated by a solid polymer, wherein said precoating polymer is a polymer of an acrylic or methacrylic acid ester of hydrogenated abietyl alcohol and is obtained by in situ polymerization accompanied by mechanical mixing in the presence of said coloring matter and a polymerization initiator, said precoating polymer being generally insoluble in said carrier liquid.

* * * * *